US005425892A

United States Patent [19]

Taneri et al.

[11] Patent Number: 5,425,892

[45] Date of Patent: * Jun. 20, 1995

[54] PERSONAL CLEANSING FREEZER BAR MADE WITH A RIGID, INTERLOCKING MESH OF NEUTRALIZED CARBOXYLIC ACID

[75] Inventors: James E. Taneri, West Chester; Mark L. Kacher, Mason; Constance S. Koczwara, Cincinnati; Steven K. Hedges, Fairfield, all of Ohio; Thomas F. Leslie, Edgewood, Ky.; Marcus W. Evans, Cincinnati, Ohio

[73] Assignee: The Procter & Gamble Company, Cincinnati, Ohio

[ * ] Notice: The portion of the term of this patent subsequent to Aug. 23, 2011 has been disclaimed.

[21] Appl. No.: 37,479

[22] Filed: Mar. 24, 1993

Related U.S. Application Data

[63] Continuation of Ser. No. 731,163, Jul. 15, 1991, abandoned.

[51] Int. Cl.[6] ..... C11D 17/00

[52] U.S. Cl. ..... 252/134; 252/108; 252/130; 252/112; 252/117; 252/120; 252/131; 252/109; 252/118; 252/121; 252/DIG. 16

[58] Field of Search ..... 252/108, 130, 112, 117, 252/120, 131, 109, 118, 121, DIG. 16, 134

[56] References Cited

U.S. PATENT DOCUMENTS

| | | | |
|---|---|---|---|
| 2,826,551 | 3/1958 | Geen | 252/89 |
| 2,988,511 | 6/1961 | Mills et al. | 252/121 |
| 3,351,558 | 11/1967 | Zimmerer | 252/137 |
| 3,835,058 | 9/1974 | White . | |
| 4,606,839 | 8/1986 | Harding | 252/130 X |
| 4,673,525 | 6/1987 | Small et al. | 252/132 |
| 4,946,618 | 8/1990 | Knochel | 252/117 |
| 4,954,282 | 9/1990 | Rys et al. | 252/117 |
| 4,963,284 | 10/1990 | Novakovic et al. | 252/108 |

FOREIGN PATENT DOCUMENTS

| | | |
|---|---|---|
| 0330435 | 6/1989 | European Pat. Off. . |
| 57-30798 | 12/1982 | Japan . |
| 57-61800 | 12/1982 | Japan . |
| 60-23156 | 6/1985 | Japan . |
| 513696 | 10/1938 | United Kingdom . |

OTHER PUBLICATIONS

Marton et al, JACS 1940 (vol. 63, pp. 1990–1993).

Ser. No. 07/617,827 filed on Nov. 26, 1990, to Kacher et al.

Ser. No. 07/717,778 filed on Jun. 18, 1991, to French et al.

Ser. No. 07/707,520 filed on May 30, 1991, to Moroney et al.

Ser. No. 07/582,270 filed on Sep. 13, 1990, to Taneri et al.

*Primary Examiner*—Asok Pal
*Assistant Examiner*—E. D. Irzinski
*Attorney, Agent, or Firm*—Leonard Williamson

[57] ABSTRACT

The invention provides a personal cleansing freezer bar comprising a skeleton structure having a relatively rigid, interlocking, semi-continuous, open, three-dimensional, crystalline mesh of neutralized carboxylic acid soap selected from the group consisting of sodium soap; wherein said bar is made by the following steps:

(1) mixing a molten mixture comprising by weight of said bar: from about 15% to about 85% of said soap and from about 15% to about 40% water;

(2) cooling said mixture to a semi-solid in a scraped wall heat exchanger freezer;

(3) extruding said semi-solid as a soft plug; and (4) further cooling said soft plug to provide said personal cleansing bar.

40 Claims, 5 Drawing Sheets

PERSONAL CLEANSING FREEZER BAR MADE WITH A RIGID, INTERLOCKING MESH OF NEUTRALIZED CARBOXYLIC ACID

This is a continuation of application Ser. No. 07/731,163, filed on Jul. 15, 1991, and now abandoned.

TECHNICAL FIELD

This invention relates to a personal cleansing freezer bar made with a rigid, semi-continuous, interlocking mesh of neutralized carboxylic acid.

BACKGROUND

The formation of a shaped, solid, three-dimensional skeleton (core) structure is described in commonly assigned, copending U.S. patent application Ser. No. 07/617,827, Kacher/Taneri/Camden/Vest/Bowles, filed Nov. 26, 1990 and now abandoned, whereby incorporated herein by reference. Kacher et al. does not specifically teach freezer bars. The present invention relates to personal cleansing freezer bars comprising said structure. A freezer bar process is disclosed in U.S. Pat. No. 3,835,058, White, issued Sep. 10, 1974, incorporated herein by reference. White, however, does not specifically teach freezer bars with such structure.

The formation of rigid, soap curd fibers of sodium laurate is reported by L. Marton et al. in a 1940 Journal of American Chemical Society (Vol. 63, pp. 1990–1993). However, there is no apparent utility for the curd.

Products made in the form of shaped solids, cakes and bars are numerous. E.g., certain high moisture and low smear personal cleansing bars are disclosed in U.S. Pat. No. 4,606,839 Harding, issued Aug. 19, 1986. Harding reports that his bars suffer from moisture loss; which loss is reduced by wrapping the bars in waterproof wraps.

It is also difficult to produce firm, nonsticky bars that contain relatively high levels (15–40%) of moisture (especially in the presence of most synthetic surfactants), hygroscopic surfactants and/or higher levels of nonsolids, such as water-soluble polyols and hydrocarbon greases.

Japanese Pat. J5 7030-798, Jul. 30, 1980, discloses transparent solid "framed" or "molded" soap in which fatty acids constituting the soap component are myristic, palmitic, and stearic acids. A transparent soap is described in which at least 90 wt. % of the fatty acids which constitute the soap component are myristic acid, palmitic acid, and stearic acid. The product is reported as a transparent, solid soap having good frothing and solidifying properties, good storage stability, and a low irritant effect on human skin. The process and transparent bar soap composition exemplified in Jap. J5 7030-798 do not appear to contain synthetic surfactant and are not made using the freezer process.

U.S. Pat. No. 2,988,511, Mills and Korpi, issued Jun. 13, 1961, for a nonsmearing "milled" detergent bar with at least 75% by weight of which consists essentially of (1) from about 15% to about 55% of normally solid detergent salts of anionic organic sulfuric reaction products which do not hydrolyze unduly under conditions of alternate wetting and drying, said salts being selected from the group consisting of the sodium and potassium salts, and said anionic organic sulfuric reaction products containing at least 50% alkyl glyceryl ether sulfonates from about 10% to about 30% of which alkyl glyceryl ether sulfonates are alkyl diglyceryl ether sulfonates, the alkyl radicals containing from about 10 to about 20 carbon atoms; (2) from about 5% to about 50% of a water-soluble soap of fatty acids having from about 10 to about 18 carbon atoms; and (3) from about 20% to about 70% of a binder material selected from the group consisting of freshly precipitated calcium soaps of fatty acids having from about 10 to about 18 carbon atoms, freshly precipitated magnesium soap of fatty acids having from about 10 to about 18 carbon atoms, starch, normally solid waxy materials which will become plastic under conditions encountered in the milling of soap and mixtures thereof. Freezer soap bars are distinguished from milled soap bars and there is still a need to improve bar smear.

SUMMARY OF THE INVENTION

The invention provides a personal cleansing freezer bar comprising a skeleton structure having a relatively rigid, interlocking, semi-continuous, open, three-dimensional, crystalline mesh of neutralized carboxylic acid soap selected from the group consisting of sodium and lithium soaps, and mixtures thereof, wherein said freezer bar is made by the following steps:

(1) mixing a molten mixture comprising by weight of said bar: from about 15% to about 85% of said soap and from about 15% to about 40% water;
(2) cooling said mixture to a semi-solid in a scraped wall heat exchanger freezer;
(3) extruding said semi-solid as a soft plug; and
(4) further cooling and crystallizing said soft plug until firm to provide said personal cleansing freezer bar.

BRIEF DESCRIPTION OF THE FIGURES

The figures are copies of microphotographs of some of the Examples disclosed herein. The figures show rigid, semi-continuous, interlocking mesh structures.

DETAILED DESCRIPTION OF THE INVENTION

Figure 1:
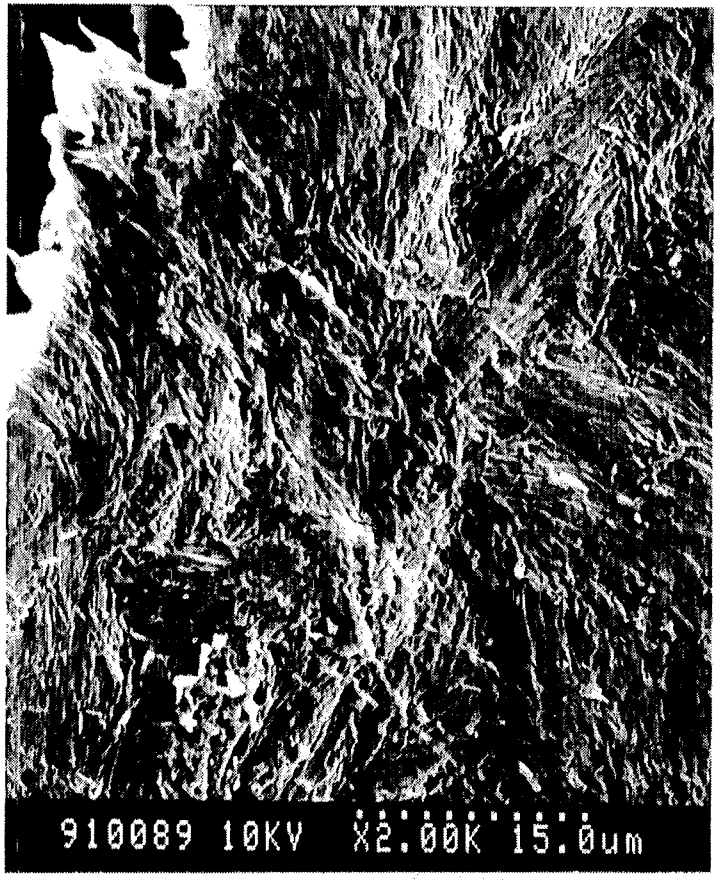

The invention provides a personal cleansing freezer bar comprising a skeleton structure having a relatively rigid, interlocking, semi-continuous, open, three-dimensional, crystalline mesh of neutralized carboxylic acid soap selected from the group consisting of sodium and lithium soaps, and mixtures thereof, wherein said freezer bar is made by the following steps:

(1) mixing a molten mixture comprising by weight of said bar: from about 15% to about 85% of said soap and from about 15% to about 40% water;
(2) cooling said mixture to a semi-solid in a scraped wall heat exchanger freezer or an equivalent freezer device;
(3) extruding said semi-solid as a soft plug; and
(4) further cooling and crystallizing said soft plug until firm to provide said personal cleansing freezer bar.

The freezer bars of the present invention can be formulated to have essentially no, or extremely low, bar smear. Some cleansing freezer bars of the present invention can comprise surprisingly large amounts of water, other liquids, greases and nonsolids. They can also contain larger amounts of hygroscopic materials including surfactants, while maintaining their rigidity.

The term "shaped, three-dimensional structure" as used herein includes forms such as bars, cakes and similarly shaped solids. The term "bar" as used herein includes the same unless otherwise specified.

The term "mesh" as used herein means an interlocking crystalline skeleton frame with voids or openings when viewed under high magnification.

The terms "core" and "skeleton frame" are often used interchangeably herein.

The term "semi-continuous" as used herein means that the entire shaped skeleton is composed of an overall mesh comprising one or more large interlocking meshes fused together.

U.S. patent application Ser. No. 07/617,827, Kacher et al., supra, does not specifically teach the required selected composition ingredients, i.e., the levels of soap and water, to successfully make a freezer bar comprising the rigid, semi-continuous, interlocking mesh.

In the preferred freezer process of the present invention, (1) mixtures of fatty acids, triglycerides, sodium hydroxide, other caustics (e.g., $Mg(OH)_2$, KOH, Ca(OH), LiOH), synthetic surfactants, waxes, greases, water, preservatives, and other desired ingredients are combined and reacted; (2) this mixture is pumped into a scraped wall heat exchanger "freezer" which cools and partially crystallizes the said mixture, subsequently extruding it onto a moving belt as a very soft paste while maintaining its shape; (3) the soft extruded plugs are cut into appropriate sizes and placed into a cooling and conditioning house until firm; and (4) the plugs are then stamped and packaged. Optionally, this mixture can be dried and/or aerated before Step 2.

The freezer process is significantly different than either the frame or milled processes. In the frame process, plugs are formed by simply pouring the liquid final composition into a mold. The mold is cooled and conditioned, until solid and the plugs are cut and stamped if need be. The frame process is not continuous. The milled bar process is even more different. In the milled process, the mixture is dried to moistures between 5% and 15% at which time the mixture is fully crystallized and is extruded as noodles. The noodles are combined with other ingredients, milled to obtain uniform mixing, and compacted into plugs with a plodder. These plugs are then cut, stamped and packaged.

The milled process is continuous but requires more unit operations and higher moisture level bars are difficult to make. Most bars made in the U.S. are made using the milled or a similar process.

DETAILED DESCRIPTION OF THE FIGURES

All figures are photomicrographs of bars which demonstrate the presence of the relatively rigid, semi-continuous, interlocking mesh structure. All figures show elongated crystalline fibers.

Figure 2:
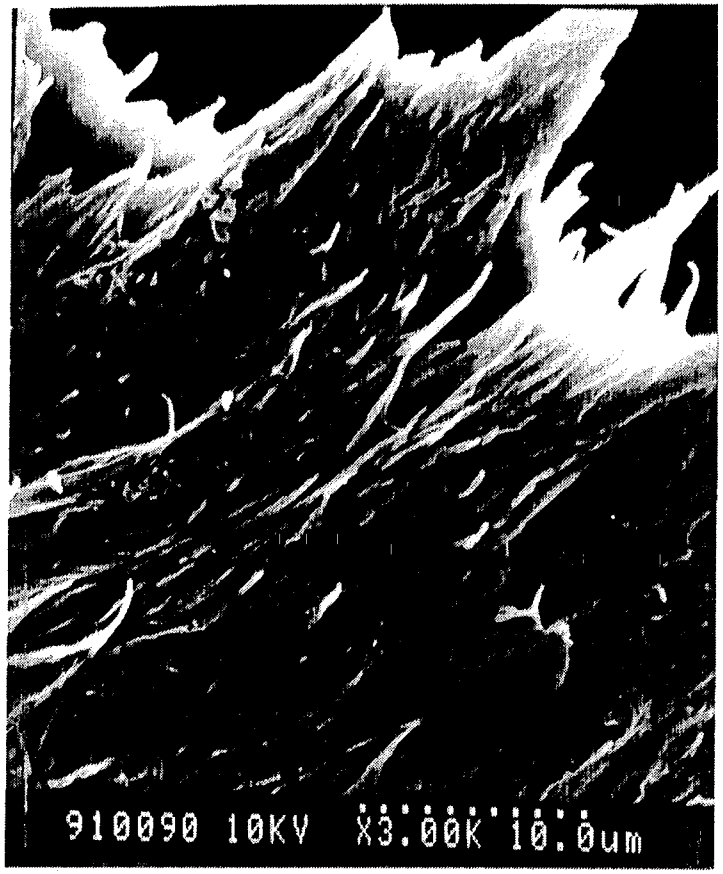

FIGS. 1 and 2, respectively, show photomicrographs at 2000× and 3000× magnifications of a fractured section of the freezer bar of the composition of Example 1.

Figure 3:
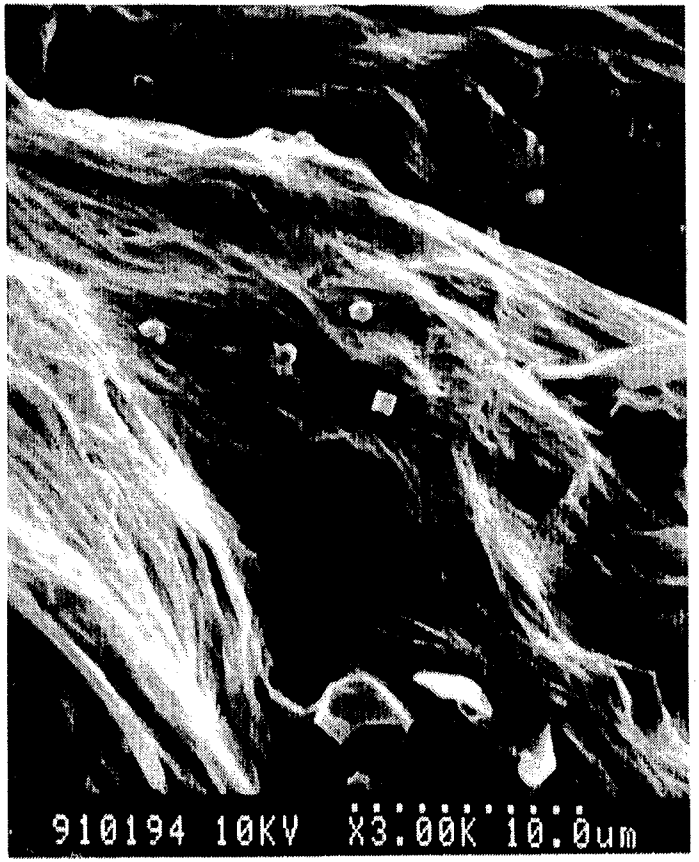

FIG. 3 is a photomicrograph at 3000× magnification of a fractured section of the freezer bar of the composition of Example 3. Example 3 contains other preferred ingredients (11.7% sodium lauroyl sarcosinate; 9.3% cocobetaine; and 5.8% propylene glycol) in addition to saturated sodium soap and water.

Figure 5:
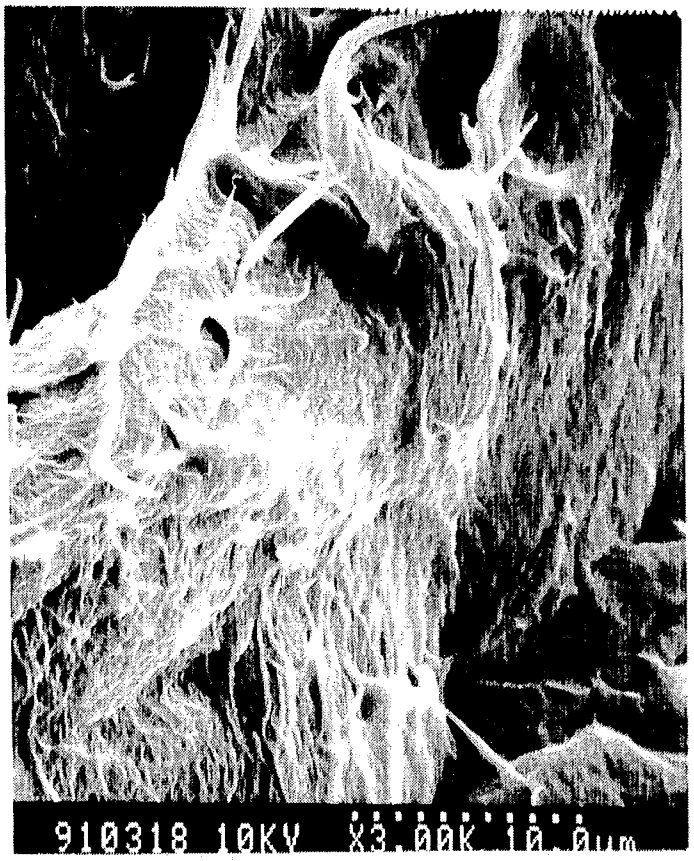
Figure 4:
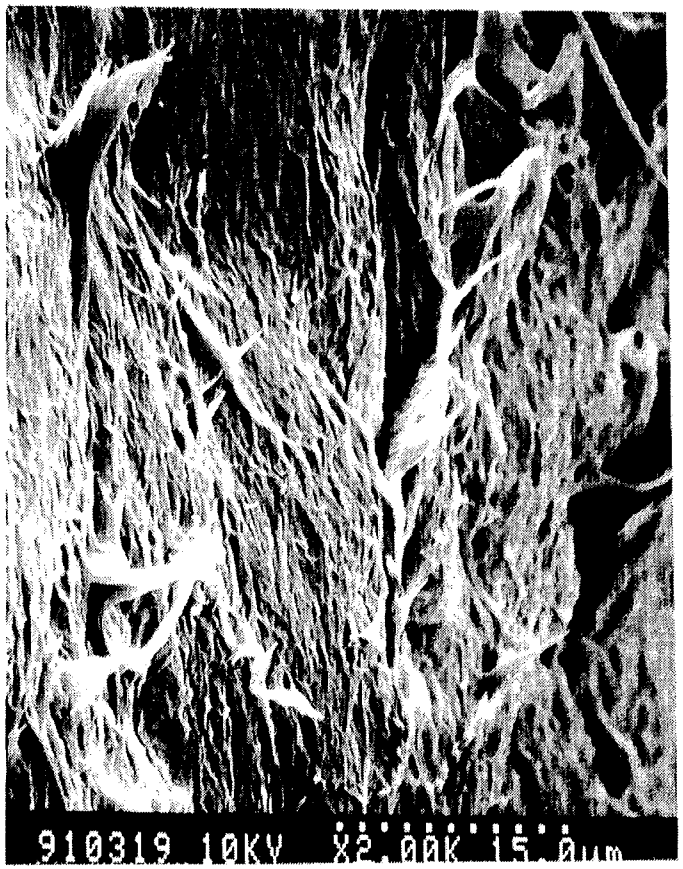

FIGS. 4 and 5, respectively, show photomicrographs at 2000× and 3000× magnifications of a fractured section of the freezer bar of the composition of Example 4, which includes potassium soap.

Figure 7:
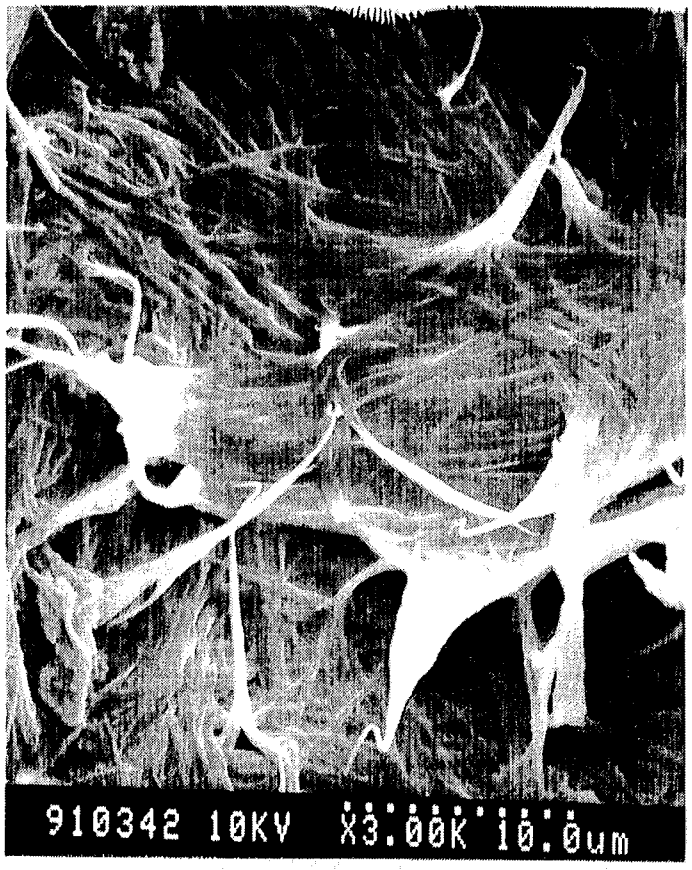
Figure 6:
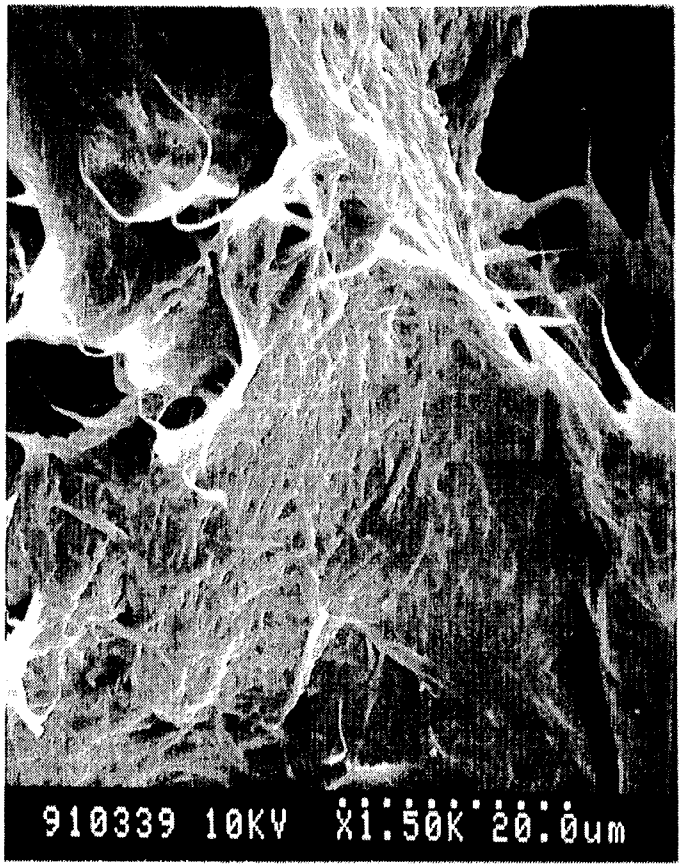
Figure 7:
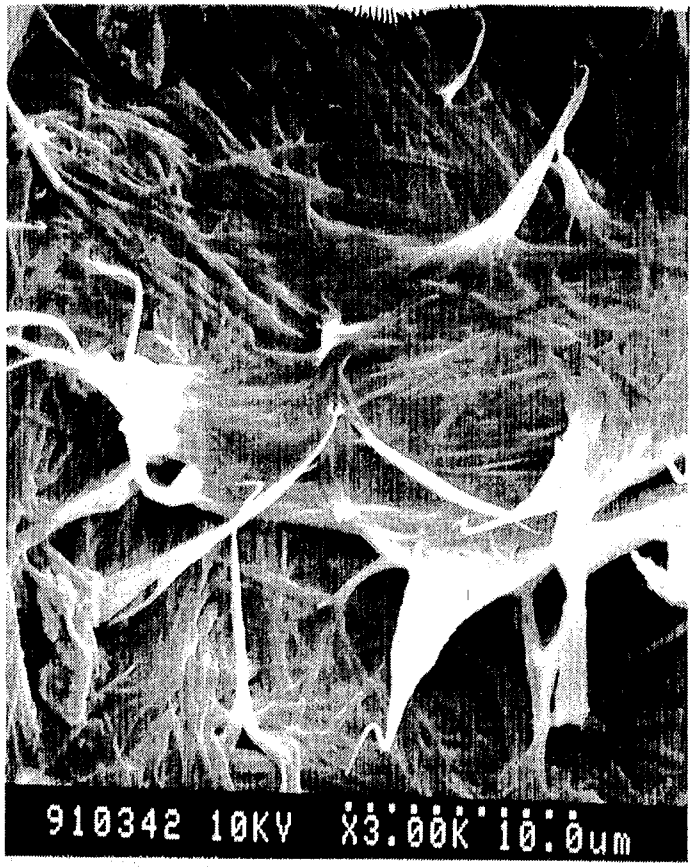
Figure 6:
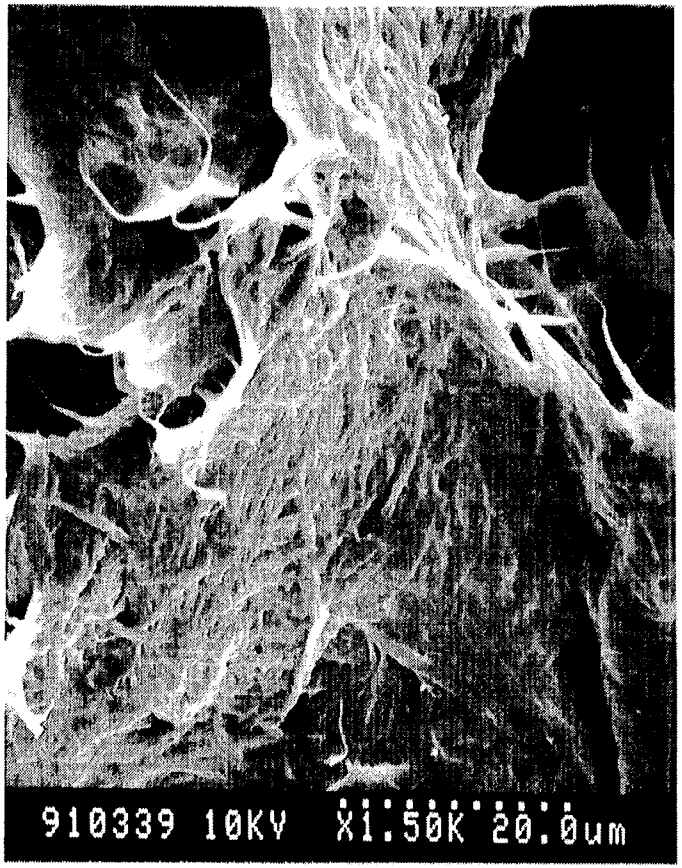

FIGS. 6 and 7, respectively, show photomicrographs at 1500× and 3000× magnifications of a fractured section of the freezer bar of the composition of Example 5, which has a lower level of sodium soap.

FIG. 8 is a photomicrograph at 2000× magnification of a fractured section of the freezer bar of the composition of Example 9. Example 9 has a high level of magnesium soap which is a viscosity-enhancing agent. Example 9 also has a relatively low level of sodium soap.

Characterization of Structure Via Scanning Electron Microscopy (SEM) Photos

All photographed samples, FIGS. 1–8, are prepared as follows.

The SEM samples preparation involves first drying the samples a minimum of two days at low humidity conditions (e.g., 27° C. and 15% relative humidity). The sample is then fractured with simple pressure to obtain a fresh surface for examination. The fractured sample is reduced in size (razor blade) to approximately a 10 mm×15 mm rectangle with a thickness of about 5 mm. The sample is mounted on an aluminum SEM stub using silver paint adhesive. The mounted sample is coated with approximately 300 angstroms of gold/palladium in a Pelco sputter coater. Prior to coating, the sample is subjected to vacuum for a period of time which is sufficient to allow sufficient loss of bar moisture assuring acceptable coating quality. After coating, the sample is transferred to the SEM chamber and examined under standard SEM operating conditions with an Hitachi Model S570 Scanning Electron Microscope in order to see the skeletal (core) frame.

DESCRIPTION OF PREFERRED EMBODIMENTS

The improved personal cleansing freezer bar of the present invention is comprised of a special core structure, i.e., a rigid, semi-continuous, interlocking mesh of neutralized fatty carboxylic acid soap selected from sodium and/or lithium soaps. The mesh occupies from about 5% to about 75%, preferably from about 15% to about 40%, by volume of the bar.

Tables 1–3 set out some preferred freezer bars which are made with the sodium salts of the fatty carboxylic acid, (FA) soap.

The percentages, ratios, and parts herein are on a total composition weight basis, unless otherwise specified. All levels and ranges herein are approximations unless otherwise specified.

TABLE 1A

Preferred Freezer Bar Ingredient Levels and Chain Lengths

| | Preferred | More Preferred | Most Preferred |
|---|---|---|---|
| Water Level | 15–40% | 20–35% | 20–30% |
| Water: Soap Ratio | 0.25:1–4:1 | 0.5:1–3:1 | 0.7:1–1.5:1 |
| FA Chain Length | $C_{12-24}$ | $C_{14-22}$ | $C_{14-18}$ |
| FA Soap Level in Total Formulation | 15–85% | 20–50% | 30–40% |
| Viscosity-Enhancing Agents | 0–70% | 1–35% | 5–30% |
| Soap + Viscosity-Enhancing Agents | 30–85% | 35–65% | 40–50% |

TABLE 1B

Preferred Viscosity-Enhancing Agents

| | Preferred | More Preferred | Most Preferred |
|---|---|---|---|
| Magnesium or Calcium Soap | 1–35% | 5–30% | 5–20% |
| Waxes, Greases, and Jellies | 1–40% | 2–35% | 5–25% |

TABLE 1B-continued

| Preferred Viscosity-Enhancing Agents | Preferred | More Preferred | Most Preferred |
|---|---|---|---|
| Aluminosilicates/Clay | 0.5-25% | 1-10% | 3-8% |

All highs and lows are not necessarily shown in Table 1. The preferred levels and ratios can vary from cation to cation, etc.

The freezer bar ingredient levels shown in Table 1A are made with the level of water indicated, but the water level of the final bars can be reduced to provide bars (core structures) which contain lower levels of water or even little or no water.

Table 1B shows preferred types and levels of viscosity-enhancing agents.

Table 2 shows some preferred levels of selected single FA chain length by weight of soap.

Table 3A shows some preferred levels of unsaturation in the FA's by weight of the soap of the present invention. Table 3B shows some preferred levels of saturated $C_{12}$–$C_{24}$ chain soap by weight of soap.

Some preferred compositions contain little or no unsaturated fatty acids and short chain FA's of ten carbon atoms or less. The terms "soap", "fatty acid (FA) salts" and "monocarboxylic acid salts" as used herein are sometimes interchangeable. "Soap" is used since it is easier to relate to and is the preferred embodiment.

TABLE 2

| The % Saturated $C_{12}$–$C_{24}$ Sodium/Lithium Soap of Single Chain Length by Weight of Soap | |
|---|---|
| Preferred | 25-100% |
| More Preferred | 50-100% |
| Most Preferred | 75-100% |

TABLE 3A

| The Total % Unsaturated and Low ($C_{10}$ or less) Chain Soaps by Weight of Soap | |
|---|---|
| Preferred | 0-20% |
| More Preferred | 0-10% |
| Most Preferred | 0-1% |

TABLE 3B

| The Total % Saturated $C_{12}$–$C_{24}$ Chain Soap by Weight of Soap | |
|---|---|
| Preferred | 75-100% |
| More Preferred | 85-100% |
| Most Preferred | 95-100% |

The highs and lows of some key preferred optional ingredients for complex soap bar compositions of this invention are set out in Table 4. None of these optional ingredients or viscosity-enhancing agents is essential for the basic, preferred bar core structure. Zero is the lowest level for each optional ingredient. Some preferred bars can contain a total of from about 1% up to about 70% of such ingredients. The idea here is that the core bars can contain large amounts of other ingredients besides soap and water. The levels set out in Table 4 are particularly illustrative for bars containing from about 15% to about 85% selected sodium soap and other ingredients.

It should be understood that bar cores (skeletons) can be made with lithium soap, but would be expected to be somewhat different from the levels and ratios given for sodium soaps.

TABLE 4

| Highs and Lows Wt. % of Other Ingredients for More Complex Sodium Soap Bars | Preferred | More Preferred | Most Preferred |
|---|---|---|---|
| Neutralized Dicarboxylic Acid | 1-40% | 2-30% | 5-25% |
| Potassium Soap | 1-15% | 2-12% | 5-10% |
| Magnesium Soap | 1-35% | 5-30% | 5-20% |
| Calcium Soap | 1-35% | 5-30% | 5-20% |
| Triethanolamine Soap | 1-15% | 2-12% | 5-10% |
| Synthetic Surfactant | 1-60% | 4-25% | 8-16% |
| Other Salts and Salt Hydrates | 0.5-50% | 1-25% | 2-15% |
| Water-Soluble Organics | 1.0-50% | 2-40% | 5-20% |
| Polymeric Mildness Enhancers | 0.25%-20% | 0.5%-10% | 1-15% |
| Waxes, Greases, and Jellies | 1-40% | 2-35% | 5-25% |
| Other Impalpable Water-insolubles | 1-60% | 4-25% | 8-16% |
| Aluminosilicates/Clay | 0.5-25% | 1-10% | 3-8% |

The soaps useful in the present invention are of the same alkyl chain lengths, i.e., selected from the 12 to 24 carbon atoms, as set out in Table 2. The same chains apply for the other soaps used in the bars of the present invention.

A highly preferred cleansing freezer bar comprises: various combinations of the core structure of sodium soap fibers, water, mild synthetic surfactants, viscosity-enhancing agents, bar appearance stabilizers, skin mildness aides and other cleansing bar adjuvants. Such preferred freezer bar can be formulated to have essentially no bar smear. Viscosity-enhancing agents, mild surfactants are defined herein.

Some preferred freezer bar compositions of the present invention which comprise lower levels of sodium soap, e.g., less than 30–35% by weight of bar, include viscosity-enhancing agents so that in the process for making the freezer bar it will maintain its shape and stand up upon extrusion from the freezer.

In yet another respect, this invention provides an improved cleansing freezer bar which is comprised of compositions that can have improved bar smear and/or be able to incorporate components that cannot normally be used in appreciable quantities in bars, such as moisture (especially in the presence of most synthetic surfactants), hygroscopic materials including surfactants, and other liquids and nonsolids such as polyols and hydrocarbon greases that improve performance properties such as lather, mildness, bar appearance, and bathtub ring, while maintaining firm, nonsticky bars.

It should be understood that some viscosity-enhancing agents" and some "other bar ingredients" used in the freezer bars of the present invention can serve more than one function and/or provide more than one benefit as indicated herein. Therefore, some of them appear under more than one category as specified herein.

Some preferred bars of the present invention comprise: a rigid, interlocking mesh of neutralized carboxylic acid fiber-like core consisting essentially of sodium fatty acid soap composed of at least 75% saturated fatty alkyl chains having 12 to 24 carbon atoms. Preferably at least about 25% of said saturated alkyl chains is of a single chain length.

Some compositions of this invention comprise the above-defined rigid mesh with water and without water. These compositions must be formed with water or another suitable solvent system. The freezer bar compositions can be made with large amounts of water and the water level in the final freezer bar composition can be reduced to as low as about 1% to 10%.

However, it is a special advantage of the freezer bars described herein that they can be dehydrated without loss of the integrity of the mesh. Some bars can be dehydrated without appreciable change in the outer dimensions. Other structures shrink while maintaining their three-dimensional form. The freezer bars herein have the unique characteristic that they are not destroyed by dehydration.

More complex freezer bars of the present invention comprise other salts of fatty acids selected from potassium, magnesium, triethanolamine and/or calcium soaps used in combination with the selected levels of sodium and/or lithium soaps. More complex cleansing bars can contain surprisingly large amounts of water, mild synthetic surfactants, bar appearance stabilizers, skin mildness aides and other cleansing bar adjuvants; yet are mild and can have very good low smear.

Some preferred viscosity-enhancing agents are Mg and Ca soaps, aluminosilicates and clays, waxes and greases such as paraffin and petrolatum, respectively.

These agents will increase viscosity by either forming an emulsion or crystallizing in the crutcher or freezer, but preferably in the freezer. In the absence of a viscosity-enhancing agent, a larger amount of sodium soap is required to crystallize in the freezer to provide the necessary viscosity for the bar composition to stand up upon extrusion onto the freezer belt. The remainder of the sodium soap will crystallize and form the interlocking mesh structure after exiting the freezer. With a viscosity-enhancing agent, less sodium soap is required to obtain the same level of the interlocking mesh structure.

The presence of a viscosity-enhancing agent lowers the total level of harsh sodium soap required to form the interlocking mesh structure.

An especially preferred viscosity-enhancing agent is petrolatum, since petrolatum typically results in higher freezer outlet temperature (FOT). It is preferred that the FOT is as high as possible while still having the bar stand up on the belt and maintain its shape. This is because more crystallization will occur after the freezer, and consequently more of the interlocking mesh structure can form, with higher FOT. Typically, the addition of petrolatum will raise the FOT from about 10° C. to 30 C. to about 60 C. to 80° C.

The sodium soap is preferably at least about 50% of the total soap present in the bar or is at least 15% of the total bar composition.

The levels of potassium and/or triethanolamine soap should not exceed one-third, preferably one-quarter, that of the sodium soap.

The synthetic detergent constituent of the bar compositions of the invention can be designated as being a detergent from the class consisting of anionic, nonionic, amphoteric and zwitterionic synthetic detergents. Both low and high lathering and high and low water-soluble surfactants can be used in the bar compositions of the present invention.

Examples of suitable synthetic detergents for use herein are those described in U.S. Pat. No. 3,351,558, Zimmerer, issued Nov. 7, 1967, at column 6, line 70 to column 7, line 74, incorporated herein by reference.

Examples include the water-soluble salts of organic, sulfonic acids and of aliphatic sulfuric acid esters, that is, water-soluble salts of organic sulfuric reaction products having in the molecular structure an alkyl radical of from 10 to 22 carbon atoms and a radical selected from the group consisting of sulfonic acid and sulfuric acid ester radicals.

Synthetic sulfate detergents of special interest are the normally solid alkali metal salts of sulfuric acid esters of normal primary aliphatic alcohols having from 10 to 22 carbon atoms. Thus, the sodium and potassium salts of alkyl sulfuric acids obtained from the mixed higher alcohols derived by the reduction of tallow or by the reduction of coconut oil, palm oil, stearine, palm kernel oil, babassu kernel oil or other oils of the coconut group can be used herein.

Other aliphatic sulfuric acid esters which can be suitably employed include the water-soluble salts of sulfuric acid esters of polyhydric alcohols incompletely esterified with high molecular weight soap-forming carboxylic acids. Such synthetic detergents include the water-soluble alkali metal salts of sulfuric acid esters of higher molecular weight fatty acid monoglycerides such as the sodium and potassium salts of the coconut oil fatty acid monoester of 1,2-hydroxypropane-3-sulfuric acid ester, sodium and potassium monomyristoyl ethylene glycol sulfate, and sodium and potassium monolauroyl diglycerol sulfate.

The synthetic surfactants and other optional materials useful in conventional cleaning products are also useful in the present invention. In fact, some ingredients such as certain hygroscopic synthetic surfactants which are normally used in liquids and which are very difficult to incorporate into normal cleansing bars are very compatible in the bars of the present invention. Additionally, it is difficult to incorporate in normal cleansing bars even nonhygroscopic surfactants with high levels of water (greater than 20% water), while this is easily accomplished in the present invention. Thus, essentially all of the known synthetic surfactants which are useful in cleansing products are useful in the compositions of the present invention. The cleansing product patent literature is full of synthetic surfactant disclosures. Some preferred surfactants as well as other cleansing product ingredients are disclosed in the following references:

| Pat. No. | Issue Date | Inventor(s) |
|---|---|---|
| 4,061,602 | 12/1977 | Oberstar et al. |
| 4,234,464 | 11/1980 | Morshauser |
| 4,472,297 | 9/1984 | Bolich et al. |
| 4,491,539 | 1/1985 | Hoskins et al. |
| 4,540,507 | 9/1985 | Grollier |
| 4,565,647 | 1/1986 | Llenado |
| 4,673,525 | 6/1987 | Small et al. |
| 4,704,224 | 11/1987 | Saud |
| 4,788,006 | 11/1988 | Bolich, Jr., et al. |
| 4,812,253 | 3/1989 | Small et al. |
| 4,820,447 | 4/1989 | Medcalf et al. |
| 4,906,459 | 3/1990 | Cobb et al. |
| 4,923,635 | 5/1990 | Simion et al. |
| 4,954,282 | 9/1990 | Rys et al. |

All of said patents are incorporated herein by reference. Some preferred synthetic surfactants are shown the Examples herein. Preferred synthetic surfactant systems are selectively designed for bar appearance stability, lather, cleansing and mildness.

It is noted that surfactant mildness can be measured by a skin barrier destruction test which is used to assess the irritancy potential of surfactants. In this test the milder the surfactant, the lesser the skin barrier is destroyed. Skin barrier destruction is measured by the relative amount of radio-labeled water ($^3H$-$H_2O$) which passes from the test solution through the skin epidermis into the physiological buffer contained in the diffusate chamber. This test is described by T. J. Franz in the *J. Invest. Dermatol.*, 1975, 64, pp. 190–195; and in U.S. Pat. No. 4,673,525, Small et al., issued Jun. 16, 1987, incorporated herein by reference, and which disclose a mild alkyl glyceryl ether sulfonate (AGS) surfactant based synbar comprising a "standard" alkyl glyceryl ether sulfonate mixture. Barrier destruction testing is used to select mild surfactants. Some preferred mild synthetic surfactants are disclosed in the above Small et al. patents and Rys et al. Some specific examples of preferred surfactants are used in the Examples herein.

Some examples of good lather enhancing detergent surfactants, mild ones, are e.g., sodium lauroyl sarcosinate, alkyl glyceryl ether sulfonate, sodium dodecyl benzene sulfonate, sulfonated fatty esters, sodium cocoyl isethionate, and sulfonated fatty acids.

Numerous examples of other surfactants are disclosed in the patents incorporated herein by reference. They include other alkyl sulfates, anionic acyl sarcosinates, methyl acyl taurates, N-acyl glutamates, acyl isethionates, linear alkyl benzene sulfonate, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Included in the surfactants are the alkyl ether sulfates with 1 to 12 ethoxy groups, especially ammonium and sodium lauryl ether sulfates.

Alkyl chains for these other surfactants are $C_8$–$C_{22}$, preferably $C_{10}$–$C_{18}$. Alkyl glycosides and methyl glucose esters are preferred mild nonionics which may be mixed with other mild anionic or amphoteric surfactants in the compositions of this invention. Alkyl polyglycoside detergents are useful lather enhancers. The alkyl group can vary from about 8 to about 22 and the glycoside units per molecule can vary from about 1.1 to about 5 to provide an appropriate balance between the hydrophilic and hydrophobic portions of the molecule. Combinations of $C_8$–$C_{18}$, preferably $C_{12}$–$C_{16}$, alkyl polyglycosides with average degrees of glycosidation ranging from about 1.1 to about 2.7, preferably from about 1.2 to about 2.5, are preferred.

Sulfonated esters of fatty esters are preferred wherein the chain length of the carboxylic acid is $C_8$–$C_{22}$, preferably $C_{12}$–$C_{18}$; the chain length of the ester alcohol is $C_1$–$C_6$. These include sodium alpha-sulfomethyl laurate, sodium alpha-sulfomethyl cocoate, and sodium alpha-sulfomethyl tallowate.

Amine oxide detergents are good lather enhancers. Some preferred amine oxides are $C_8$–$C_{18}$, preferably $C_{10}$–$C_{16}$, alkyl dimethyl amine oxides and $C_8$–$C_{18}$, preferably $C_{12}$–$C_{16}$, fatty acyl amidopropyl dimethyl amine oxides and mixtures thereof.

Fatty acid alkanolamides are good lather enhancers. Some preferred alkanolamides are $C_8$–$C_{18}$, preferably $C_{12}$–$C_{16}$, monoethanolamides, diethanolamides, and monoisopropanolamides and mixtures thereof.

Other detergent surfactants are alkyl ethoxy carboxylates having the general formula:

$$RO(CH_2CH_2O)_kCH_2COO^-M^+$$

wherein R is a $C_{8-22}$ alkyl group, k is an integer ranging from 0 to 10, and M is a cation; and polyhydroxy fatty acid amides having the general formula $$R^2-\overset{\overset{\displaystyle O}{\|}}{C}-\overset{\overset{\displaystyle R^1}{|}}{N}-Z$$

wherein $R^1$ is H, a $C_{1-4}$ hydrocarbyl, 2-hydroxy ethyl, 2-hydroxy propyl, or mixtures thereof, $R^2$ is a $C_{5-31}$ hydrocarbyl, and Z is a polyhydroxyhydrocarbyl having a linear hydrocarbyl chain with at least 3 hydroxyl groups directly connected to the chain, or an alkoxylated derivative thereof.

Betaines are good lather enhancers. Betaines such as $C_8$–$C_{18}$, preferably $C_{12}$–$C_{16}$, alkyl betaines, e.g., coco betaines or $C_8$–$C_{18}$, preferably $C_{12}$–$C_6$, acyl amido betaines, e.g., cocoamidopropyl betaine, and mixtures thereof, are preferred.

Some of the preferred surfactants are hygroscopic synthetic surfactants which absorb at least about 20% of their dry weight at 26° C. and 80% relative humidity in three days. Hygroscopic surfactants help to improve bar lather. Some preferred hygroscopic synthetic surfactants are listed below. Note that all are not hygroscopic.

Hygroscopicity of Some Surfactants

The hygroscopic surfactants have a minimum of 20% total moisture gain.

| | Total % Moisture Pick-Up* |
|---|---|
| Class: Nonionic | |
| Sulfonates | |
| Na $C_8$ Glyceryl Ether Sulfonate | 39.8 |
| Na $C_{12-14}$ Glyceryl Ether Sulfonate | 22.9 |
| Na $C_{16}$ Glyceryl Ether Sulfonate | 71.4 |
| Sodium Cocomonoglyceride Sulfonate | 3.5 |
| Sodium Salt of $C_{8-16}$ Alkyl Glyceryl Ether Sulfonates | |
| Alpha Sulfo Esters and Acids | |
| Na Alpha Sulfo Methyl Laurate/Myristate | 39.3 |
| Na Alpha Sulfo Methyl Myristate | 44.5 |
| Na Alpha Sulfo Hexyl Laurate | 23.2 |
| Na Alpha Sulfo Methyl/Hexyl Laurate and Myristate | 26.3 |
| Na Alpha Sulfo Methyl Palmitate | 3.7 |
| Na Alpha Sulfo Methyl Stearate | 4.2 |
| Na 2-Sulfo Lauric Acid | 0.2 |
| Na 2-Sulfo Palmitic Acid | 3.8 |
| Na 2-Sulfo Stearic Acid | 0.0 |
| $R_1$—$C(SO_3$—$Na^+)$—$CO_2R_2$ | $R_1 = C_{8-14}$; $R_2 = C_{1-8}$ |
| Sodium Alkyl Isethionates | |
| Sodium Lauryl Isethionate | 31.7 |
| Sodium Cocoyl Isethionate | 11.0 |
| Sarcosinates | |
| Sodium Lauryl Sarcosinate | 8.8 |
| Sodium Stearyl Sarcosinate | 13.3 |
| Sodium Cocoyl Sarcosinate | 18.7 |
| Alkyl Sulfates | |
| Sodium Lauryl Sulfate | 28.2 |
| Sodium Laureth-1 Sulfate | 37.6 |
| Sodium Oleyl Sulfate | 20.3 |
| Sodium Cetearyl Sulfate | 4.7 |
| Sodium Cetyl Sulfate | 2.25 |
| $R_1(OCH_2CH_2)_nOSO_3$—X | $R_1 = C_{8-14}$, $C_{16-20}$ with at least one double bond, X = 0–18 |
| Acyl Glutamates | |
| Sodium Cocoyl Glutamate | 26.7 |
| Sodium Lauryl Glutamate | 17.8 |
| Sodium Myristyl Glutamate | 18.1 |
| Sodium Stearyl Glutamate | 12.0 |

-continued

| | Total % Moisture Pick-Up* |
|---|---|
| Alkyl Ether Carboxylates | |
| Sodium Laureth-5 Carboxylate | 32.2 |
| Sodium Palmityl-20 Carboxylate | 50.2 |
| $R_1$—(O—$CH_2CH_2$)$_n$$CO_2$— $R_1$ = $C_{8-18}$, n = 1-30 | |
| Sulfosuccinates | |
| Disodium Laureth Sulfosuccinate | 33.6 |
| Phosphates | |
| Sodium Monoalkyl (70% $C_{12}$/ 30% $C_{14}$) Phosphate | 21.1 |
| Class: Amphoterics | |
| Betaines | |
| Coco Betaine | 70.0 |
| Cocoamidopropyl Betaine | 48.2 |
| Palmitylamidopropyl Betaine | 46.5 |
| Isostearamidopropyl Betaine | 44.3 |
| Sultaines | |
| Cocoamidopropylhydroxy Sultaine | 59.5 |
| Amine Oxides | |
| Palmityl Dimethyl Amine Oxide | 34.0 |
| Myristyl Dimethyl Amine Oxide | 46.0 |
| Cocoamidopropyl Amine Oxide | 43.3 |
| Protein Derived | |
| Na/TEA $C_{12}$ Hydrolyzed Keratin | 34.7 |

*3 days, 26° C./80% Relative Humidity

The total moisture pick-up is calculated as percent content (after material is dried down) plus percent weight gain.

Polymeric skin mildness aids are disclosed in the Small et al. and Medcalf et al. patents. The cationic synthetic polymers useful in the present invention are cationic polyalkylene imines, ethoxypolyalklene imines, and poly[N-[-3-(dimethylammonio)propyl]-N'-[3-(ethyleneoxyethylene dimethylammonio)propyl]urea dichloride] the latter of which is available from Miranol Chemical Company, Inc. under the trademark of Miranol A-15, CAS Reg. No. 68555-36-2.

Preferred cationic polymeric skin conditioning agents of the present invention are those cationic polysaccharides of the cationic guar gum class with molecular weights of 1,000 to 3,000,000. More preferred molecular weights are from 2,500 to 350,000. These polymers have a polysaccharide backbone comprised of galactomannan units and a degree of cationic substitution ranging from about 0.04 per anhydroglucose unit to about 0.80 per anhydroglucose unit with the substituent cationic group being the adduct of 2,3-epoxypropyltrimethyl ammonium chloride to the natural polysaccharide backbone. Examples are JAGUAR ® C-14-S, C-15, C-17, and C-376FA, sold by Celanese Corporation. In order to achieve the benefits described in this invention, the polymer must have characteristics, either structural or physical which allow it to be suitably and fully hydrated and subsequently well incorporated into the soap matrix.

A mild skin cleansing bar of the present invention can contain from about 0.5% to about 20% of a mixture of a silicone gum and a silicone fluid wherein the gum:fluid ratio is from about 10:1 to about 1:10, preferably from about 4:1 to about 1:4, most preferably from about 3:2 to about 2:3.

Silicone gum and fluid blends have been disclosed for use in shampoos and/or conditioners in U.S. Pat. Nos. 4,906,459, Cobb et al., issued Mar. 6, 1990; 4,788,006, Bolich, Jr. et al., issued Nov. 29, 1988; 4,741,855, Grote et al., issued May 3, 1988; 4,728,457, Fieler et al., issued Mar. 1, 1988; 4,704,272, Oh et al., issued Nov. 3, 1987; and 2,826,551, Geen, issued Mar. 11, 1958, all of said patents being incorporated herein by reference.

The silicone component can be present in the bar at a level which is effective to deliver a sensory skin benefit, for example, from about 0.5% to about 20%, preferably from about 1.5% to about 16%, and most preferably from about 3% to about 12% of the composition. Silicone fluid, as used herein, denotes a silicone with viscosities ranging from about 5 to about 600,000 centistokes, most preferably from about 350 to about 100,000 centistokes, at 25° C. Silicone gum, as used herein, denotes a silicone with a mass molecular weight of from about 200,000 to about 1,000,000 and with a viscosity of greater than about 600,000 centistokes. The molecular weight and viscosity of the particular selected siloxanes will determine whether it is a gum or a fluid. The silicone gum and fluid are mixed together and incorporated into the compositions of the present invention.

Other ingredients of the present invention are selected for the various applications. E.g., perfumes can be used in formulating the skin cleansing products, generally at a level of from about 0.1% to about 2.0% of the composition. Alcohols, hydrotropes, colorants, and fillers such as talc, clay, water-insoluble, impalpable calcium carbonate and dextrin can also be used. Cetearyl alcohol is a mixture of cetyl and stearyl alcohols. Preservatives, e.g., sodium ethylenediaminetetraacetate (EDTA), generally at a level of less than 1% of the composition, can be incorporated in the cleansing products to prevent color and odor degradation. Antibacterials can also be incorporated, usually at levels up to 1.5%. The above patents disclose or refer to such ingredients and formulations which can be used in the bars of this invention, and are incorporated herein by reference.

Some freezer bars of this invention contain from about 15% to about 85% said sodium fatty acid soap fibers; from about 15% to about 60% water; and at least about 1% of another bar ingredient selected from: other soaps, viscosity-enhancing agents, moisturizers, colorants, solvents, water-soluble organics, salt and salt hydrates, other impalpable water-insolubles, fillers, synthetic detergent surfactants, polymeric skin feel and mildness aids, perfumes, preservatives, and mixtures thereof.

Some freezer bars of this invention comprise: 20%–50% fibrous sodium fatty acid soap composed of at least about 75% saturated fatty alkyl chains having 12–24 carbon atoms of which at least about 25% of said saturated fatty alkyl chains is of a single chain length. See Table 1A for more preferred levels.

Some personal cleansing soap freezer bar compositions comprise a rigid, interlocking mesh of sodium soap fibers; wherein the sodium fatty acid soap is composed of at least about 75% saturated fatty alkyl chains having 12–24 carbon atoms of which at least about 25% of said saturated fatty alkyl chains is of a single chain length; and from about 2% to about 40% by weight of a hygroscopic synthetic surfactant wherein said hygroscopic synthetic surfactant is selected from surfactants which absorb at least about 20% of its dry weight in water at 26° C. and 80% Relative Humidity in three days.

Also some preferred freezer bars can have the combination of 20–35% water and up to 40% of the synthetic detergent herein described. Some bars also contain high levels (15–60%) of very mild ingredients, which replace harsher sodium soap and result in very mild bars. Some freezer bars can contain up to 40% petrolatum which can improve the mildness and processing of the bars. The mild ingredients also include water-soluble organics, waxes and greases with preferred levels as specified in Table 4.

Some of the ingredients improve bar appearance. Bar appearance (water-retaining and/or shrinkage prevention) aids are preferably selected from the group consisting of:

compatible salt and salt hydrates;
water-soluble organics such as polyols, urea;
aluminumosilicates and clays; and
mixtures thereof, as set out in Table 4.

Water-soluble organics are also used to stabilize the appearance of the bar soaps of the present invention. Some preferred water-soluble organics are propylene glycol, glycerine, ethylene glycol, sucrose, and urea, and other compatible polyols.

A particularly suitable water-soluble organic is propylene glycol. Other compatible organics include polyols, such as ethylene glycol or 1,7-heptane-diol, respectively the mono- and polyethylene and propylene glycols of up to about 8,000 molecular weight, any mono-$C_{1-4}$ alkyl ethers thereof, sorbitol, glycerol, glycose, diglycerol, sucrose, lactose, dextrose, 2-pentanol, 1-butanol, mono- di- and triethanolamine, 2-amino-1-butanol, and the like, especially the polyhydric alcohols.

The term "polyol" as used herein includes nonreducing sugar, e.g., sucrose. Unless otherwise specified, the term "sucrose" as used herein includes sucrose, its derivatives, and similar nonreducing sugars and similar polyols which are substantially stable at a soap processing temperature of up to about 210° F. (98° C.), e.g., trialose, raffinose, and stachyose; and sorbitol, lactitol and maltitol.

Sucrose will not reduce Fehling's solution and therefore is classified as a "nonreducing" disaccharide. It has been produced since 2000 B.C. from the juice of the sugar cane and since the early 1800's from the sugar beet. Sucrose is a sweet, crystalline (monoclinic) solid which melts at 160°-186° C., depending on the solvent of crystallization.

Compatible salt and salt hydrates are used to stabilize the bar soap appearance via the retention of water. Some preferred salts are sodium chloride, sodium sulfate, disodium hydrogen phosphate, sodium pyrophosphate, sodium tetraborate.

Generally, compatible salts and salt hydrates include the sodium, potassium, magnesium, calcium, aluminum, lithium, and ammonium salts of inorganic acids and small (6 carbons or less) carboxylic or other organic acids, corresponding hydrates, and mixtures thereof, are applicable. The inorganic salts include chloride, bromide, sulfate, metasilicate, orthophosphate, pyrophosphate, polyphosphate, metaborate, tetraborate, and carbonate. The organic salts include acetate, formate, methyl sulfate, and citrate.

Water-soluble amine salts can also be used. Monoethanolamine, diethanolamine, and triethanolamine (TEA) chloride salts are preferred.

Viscosity-Enhancing Agents

Aluminosilicates and other clays are useful in the present invention as viscosity-enhancing agents. Some preferred clays are disclosed in U.S. Pat. Nos. 4,605,509 and 4,274,975, incorporated herein by reference.

Other types of clays include zeolite, kaolinite, montmorillonite, attapulgite, illite, bentonite, and halloysite. Other preferred clays are kaolin and cal-cined clays.

Waxes, jellies, and greases can be effective viscosity-enhancing agents. Additionally, they can also be mildness-enhancement aids. Waxes, jellies, and greases include petroleum based waxes (paraffin, microcrystalline, and petrolatum), vegetable based waxes (carnauba, palm wax, candelilla, sugarcane wax, and vegetable derived triglycerides) animal waxes (beeswax, spemaceti, wool wax, shellac wax, lanolin, and animal derived triglycerides), mineral waxes (montar, ozokerite, and ceresin) and synthetic waxes (Fischer-Tropsch). Waxes are fully solid at room temperature, (e.g., 15°-30° C.), while jellies and greases are semi-solid at room temperature.

A preferred hydrocarbon grease is petrolatum, such as Snow White Petrolatum USP from Penreco Co., with a melting point range of from about 122° F. to about 135° F. (50°-57° C.).

A preferred wax is used in the Examples herein. A useful wax has a melting point (M.P.) of from about 120° F. to about 185° F. (49°-85° C.), preferably from about 125° F. to about 175° F. (52°-79° C.). A preferred paraffin wax is a fully refined petroleum wax having a melting point ranging from about 130° F. to about 140° F. (49°-60° C.). This wax is odorless and tasteless and meets FDA requirements for use as coatings for food and food packages. Such paraffins are readily available commercially. A very suitable paraffin can be obtained, for example, from The Standard Oil Company of Ohio under the trade name Factowax R-133.

Other suitable waxes are sold by the National Wax Co. under the trade names of 9182 and 6971, respectively, having melting points of 131° F. and 130° F. (~55° C.).

The paraffin preferably is present in the bar in an amount ranging from about 3% to about 20% by weight. The paraffin ingredient is used in the product to impart skin mildness, plasticity, firmness, and processability. It also provides a glossy look and smooth feel to the bar.

The paraffin ingredient is optionally supplemented by a microcrystalline wax. A suitable microcrystalline wax has a melting point ranging, for example, from about 140° F. (60° C.) to about 185° F. (85° C.), preferably from about 145° F. (62° C.) to about 175° F. (79° C.). The wax preferably should meet the FDA requirements for food grade microcrystalline waxes. A very suitable microcrystalline wax is obtained from Witco Chemical Company under the trade name Multiwax X-145A. The microcrystalline wax preferably is present in the bar in an amount ranging from about 0.5% to about 5% by weight. The microcrystalline wax ingredient imparts pliability to the bar at room temperatures.

The magnesium and calcium salts of the saturated fatty acids of chain length $C_{12}$-$C_{24}$ can also be used as viscosity-enhancing agents. These are milder than the corresponding sodium salt of the carboxylic acids and can also impart less draggy rinse feel.

Preferred Bar Processing

The following process is used to make the exemplified freezer bars of the present invention. The process comprises the following steps:

Step 1—Mixing

The soap specified in the formulation is made in situ by mixing the desired fatty acids, consisting essentially of $C_{12}$–$C_{24}$ chain lengths, with the appropriate base or mixture of bases, consisting essentially of sodium, lithium, magnesium, calcium, and potassium hydroxide and triethanolamine. The fatty acid, base, and water are mixed at from about 170° F. to about 200° F. (76°–93° C.) to form the soap. Sufficient water is used such that the mixture is stirrable. The other ingredients are added, maintaining the temperature of from about 180° F. to about 200° F. (82°–93° C.). The optimal mixing temperatures can vary depending on the particular formulation.

Step 2 Optionals—Aeration, Minor Addition, and Flash Drying Optionals

Aerate (optional) said mix and add perfume (only if drying) and other minors with positive displacement pump or other in-line mixer. The mixture of Step (1) is optionally dried to reduce the amount of said water to the desired level, preferably 20–40% water. The flash drying temperature is from about 225° F. to about 315° F. (135°–157° C.) at pressure of from about 30 to abut 100 psi (115–517 mm Hg).

Step 3—-Freezer

Cool the mix using a scraped wall heat exchanger (freezer) to partially crystallize the components from an initial temperature of from about 180° F. to about 200° F. (82°–93° C.) or from about 200° F. to about 220° F. (93°–104° C.), if dried, to a final temperature preferably from about 135° F. to about 180° F. (57°–82° C.), more preferably from about 145° F. to about 180° F. (63°–82° C.), and most preferably from about 155° F. to about 175° F. (68°–79° C.). This final temperature, also referred to herein as the Freezer Outlet Temperature (FOT), is typically the maximum temperature that will form a smooth plug that holds its shape once extruded onto a moving belt (Step 4).

Step 4—Extrusion

The cooled mix of Step 3 is extruded out onto a moving belt as a soft plug which is then cooled and fully crystallized and then stamped and packaged. The plugs are preferably formed via an extrusion operation, as shown in U.S. Pat. No. 3,835,059, supra. Some of the composition crystallizes in the freezer (Step 3) in order to provide a semi-solid having a sufficient viscosity to stand up on the belt, while further crystallization occurs after extrusion, resulting in hardening of the bar. The final crystallization of the sodium soap forms the interlocking, semi-continuous, open mesh structure in the freezer bar of the present invention.

EXAMPLES

The following examples are illustrative and are not intended to limit the scope of the invention. All bar compositions are made using the freezer process as specified herein. All levels and ranges, temperatures, results etc., used herein are approximations unless otherwise specified.

Description of Testing for Examples

1. The hardness of a bar is determined by measuring the depth penetration (in mm) of a conically shaped, weighted probe into the bar. A hardness measurement of 5 mm or less indicates a very hard bar; 5–10 mm indicates a moderately hard bar; and greater than 10 mm indicates a soft bar.
2. The smear grade is determined by: (1) placing a soap bar on a perch in a 1400 mm diameter circular dish; (2) adding 200 ml of room temperature water to the dish such that the bottom 3 mm of the bar is submerged in water; (3) letting the bar soak overnight (15 hours); (4) turn the bar over and grade qualitatively for the combined amount of smear, and characteristics of smear, depth of smear on a scale where 10 equals no smear, 9.0–9.5 equals extremely low smear, 7.0–8.5 equals good smear superior to currently marketed bars, 4.5–6.5 equals smear essentially equivalent to the best of currently marketed bars, and 4.0 or less equals very poor smear.

| Fatty Acid Chain Length Distribution (% of Total Fatty Acid) | | | | |
|---|---|---|---|---|
| Ingredient | Ex. 1 Wt. % | Ex. 2 Wt. % | Ex. 3 Wt. % | Ex. 4 Wt. % |
| $C_{12}$ | 12.5 | 12.5 | | |
| $C_{14}$ | 12.5 | 12.5 | | |
| $C_{16}$ | 37.5 | 37.5 | 50.0 | 50.0 |
| $C_{18}$ | 37.5 | 37.5 | 50.0 | 50.0 |
| Composition (% of Total Bar): | | | | |
| Sodium Soap | 77.18 | 44.4 | 44.4 | 34.1 |
| Potassium Soap | | | | 8.5 |
| Free Fatty Acid | — | 0.13 | 1.17 | 1.12 |
| Magnesium Soap | — | — | — | — |
| Paraffin (M.P. 55° C.) | — | 3.5 | — | — |
| Sodium Lauroyl Sarcosinate | — | 5.84 | 11.67 | 11.21 |
| CocoBetaine | — | 11.65 | 9.34 | 8.97 |
| Propylene Glycol | — | 5.84 | 5.84 | 5.61 |
| Sodium Chloride | 0.57 | 3.6 | 3.11 | 2.99 |
| Water | 22.2 | 24.7 | 24.0 | 27.0 |
| Freezer Outlet Temperature | 66° C./ 152° F. | 59° C./ 139° F. | 59° C./ 139° F. | 63° C./ 145° F. |
| Hardness (mm Penetration) | 2.9 | 5.5 | 7.3 | 6.3 |
| Smear | 10 | 7.5 | 7.0 | 7.5 |

Example 1 comprises sodium soap and water. The interlocking mesh structure is shown in FIGS. 1 and 2. There is no smear for Example 1, but lather is low.

Examples 2–4 demonstrate the ability to incorporate other actives in a freezer bar having the interlocking mesh. FIGS. 3–5 show interlocking mesh structure. Examples 2–4 comprise synthetic surfactants, potassium soap, and/or propylene glycol. Examples 2–4 are firm bars with good smear and good lather.

| Composition (% of Total Bar) | Ex. 5 Wt. % | Ex. 6 Wt. % | Ex. 7 Wt. % | Ex. 8 Wt. % |
|---|---|---|---|---|
| Sodium Myristate Soap (100%) | 28.52 | 29.94 | 33.1 | 24.86 |
| Free Fatty Acid | 0.95 | 1.00 | 1.10 | 0.99 |
| Petrolatum, White USP | — | 19.96 | 22.07 | 9.95 |
| Paraffin (M.P. 55° C.) | 6.18 | — | — | 5.97 |
| Cal-cined Clay | 3.80 | 2.99 | 3.31 | 3.98 |
| Sodium Lauroyl Sarcosinate | 6.65 | 6.99 | 7.72 | 6.96 |
| CocoBetaine | 4.75 | 4.99 | 5.52 | 4.97 |
| Propylene Glycol | 10.46 | — | — | 9.95 |
| Sodium Chloride | 3.84 | 1.04 | 1.15 | 2.03 |
| Perfume | — | 0.20 | 0.22 | — |
| Water | 34.53 | 32.6 | 25.5 | 30.01 |
| Freezer Outlet Temperature | 49° C./ 120° F. | 61° C./ 142° F. | 62° C./ 143° F. | 48° C./ 118° F. |
| Hardness (mm Penetration) | 7.6 | 4.90 | 5.0 | 6.5 |

-continued

| Composition (% of Total Bar) | Ex. 5 Wt. % | Ex. 6 Wt. % | Ex. 7 Wt. % | Ex. 8 Wt. % |
|---|---|---|---|---|
| Smear | 8.5 | 9.5 | 9.0 | 9.0 |

The comparison of Examples 5 and 6 demonstrates the effect of petrolatum on processing the freezer bar and smear. Example 5 has good smear of 8.5, but Example 6 has a better smear of 9.5. The structure of Example 5 is shown in FIGS. 6 and 7. Example 6 also has a better (higher) freezer outlet temperature (FOT) than Example 5. Examples 6 and 7 are similar, except that the product of Example 7 was partially dried before entering the freezer. No loss on key performance parameters is seen.

The freezer bar of Example 8 comprises a combination of paraffin, petrolatum, clay and a lower level of sodium soap. Examples 5–8 all have very low smear and good lather.

| Composition (% of Total Bar) | Ex. 9 Wt. % | Ex. 10 Wt. % | Ex. 11 Wt. % |
|---|---|---|---|
| Sodium Myristate Soap (100%) | 18.12 | 36.09 | 28.0 |
| Free Fatty Acid | 0.10 | 0.57 | 0.50 |
| Magnesium Soap | 27.16 | 11.29 | 5.0 |
| Petrolatum, White USP | — | — | 22.50 |
| Sodium Lauroyl Sarcosinate | 9.56 | 10.18 | 3.0 |
| CocoBetaine | 7.51 | 5.66 | 10.0 |
| Propylene Glycol | 10.87 | 9.05 | 3.5 |
| Sodium Chloride | 2.65 | 1.64 | 2.58 |
| Perfume | — | 0.50 | 0.50 |
| Water | 23.70 | 25.0 | 24.08 |
| Water/Soap Ratio | 1.3:1 | 0.7:1 | 0.9:1 |
| Freezer Outlet Temperature | 48° C./119° F. | 56° C./132° F. | 79° C./175° F. |
| Hardness (mm Penetration) | 7.3 | 5.9 | 3.8 |
| Smear | 5.3 | 7.25 | 9.5 |

Example 9 demonstrates the ability to make a firm freezer bar with average smear with 34% liquids (water +propylene glycol), 17% synthetic surfactants, and 27% magnesium soap viscosity-enhancing agent, and a lower level, 19%, of sodium soap. The structure for Example 9 is shown in FIG. 8. The hardness and smear of Example 9 are about equal to the averages of the current soap bars on the market today.

Example 10 demonstrates the ability to make firm, good smearing freezer bars with about twice the level of sodium soap vs. Example 9 and about half the magnesium soap level vs. Example 9. Example 10 has the best lather of the Examples.

Example 11 demonstrates a freezer bar comprising 5% magnesium soap and 22.5% petrolatum. Example 11 is a firm freezer bar with excellent smear and good lather.

The crystalline meshes of the freezer bars of Examples 9, 10, and 11 are estimated to occupy, respectively, about 15%, 15–35%, and 5–25%, by volume of the bars.

What is claimed is:

1. A personal cleansing freezer bar comprising a skeleton structured having a rigid interlocking, semi-continuous open, three-dimensional crystalline mesh of neutralized carboxylic acid soap selected from the group consisting of sodium and lithium soaps, and mixtures thereof, wherein said freezer bar is made by the following steps:

(1) mixing a molten mixture comprising by weight of said bar: from about 15% to about 85% of said soap and from about 15% to about 40% water;

(2) cooling said mixture to a semi-solid in a scraped wall heat exchanger freezer;

(3) extruding said semi-solid as soft plug; and (4) further cooling said soft plug to provide said personal cleansing freezer bar;

and wherein said mix of step (1) is cooled from about 82° C. to about 92° C. to a freezer outlet step (3) temperature of from about 57° C. to about 82° C.

2. The freezer bar of claim 1 wherein said mesh occupies from about 5% to about 75% by volume of said freezer bar.

3. The freezer bar of claim 2 wherein said mesh occupies from about 15% to about 40% by volume of said freezer bar.

4. The freezer bar of claim 1 wherein said mesh comprises elongated crystals.

5. The freezer bar of claim 4 wherein said mesh comprises fibrous crystals.

6. The freezer bar of claim 4 wherein said mesh comprises lithium salt neutralized carboxylic acid crystals.

7. The freezer bar of claim 6 wherein said mesh comprises lithium myristate.

8. The freezer bar of claim 5 wherein said mesh comprises sodium salts of carboxylic acid fibrous crystals.

9. The freezer bar of claim 8 wherein said mesh occupies from about 5% to about 75% by volume of said freezer bar.

10. The freezer bar of claim 9 wherein said mesh occupies from about 15% to about 40% by volume of said freezer bar.

11. The freezer bar of claim 1 wherein said crystalline mesh comprises sodium salts of monocarboxylic acid fibrous crystals.

12. The freezer bar of claim 11 wherein said soap is salts of carboxylic fatty acid having saturated fatty alkyl chains of $C_{12}$–$C_{24}$ carbon atoms and mixtures thereof at a level of from about 75% to about 100% by weight of total fatty acid soap; and wherein from 0% to about 20% of the total fatty acids are selected from the group consisting of: (a) unsaturated fatty acid soaps and (b) saturated soap with fatty acid chain lengths of $C_{10}$ and shorter.

13. The freezer bar of claim 12 wherein said sodium fatty acid soap is at least about 85% saturated fatty acid soap having 12–24 carbon atoms of which from about 25% to about 100% is of a single fatty acid chain length.

14. The freezer bar of claim 13 wherein said bar comprises: from about 1% to about 70% by weight of the bar of a viscosity-enhancing agent, wherein the total level of said sodium salt of carboxylic acid and viscosity-enhancing agent is from about 30% to about 85% by bar weight and wherein said viscosity-enhancing agent is selected from the group consisting of:

(A) from about 1% to about 40% wax, jelly or grease, and mixtures thereof;

(B) from about 1% to about 35% of a saturated $C_{12}$–$C_{24}$ fatty acid magnesium or calcium soap, and mixtures thereof;

(C) from about 0.5% to about 25% of aluminosilicate or clay;

and mixtures of said (A), (B) and (C).

15. The freezer bar of claim 14 wherein said (A) level is from about 2% to about 35%; said (B) level is from about 5% to about 30%; and said (C) level is from about 1% to about 10%.

16. The freezer bar of claim 15 wherein said said (A) level is from about 5% to about 25%; said (B) level is from about 5% to about 20%; and said (C) level is from about 3% to about 8%.

17. The freezer bar of claim 16 wherein said viscosity-enhancing agents are selected from magnesium soap and petrolatum.

18. The freezer bar of claim 14 wherein said bar comprises:

from about 1% to about 35% of said viscosity-enhancing agent;

from 0% to about 70% of another bar ingredient selected from the group consisting of:

(a) from about 1% to about 15% said potassium soap;

(b) from about 1% to about 15% triethanolamine soap;

(c) from about 1% to about 40% of a compatible salt of dicarboxylic acid;

(d) from about 1% to about 60% of synthetic surfactant;

(e) from about 1% to about 60% of other impalpable water-insolubles;

(f) from about 1% to about 50% of a water-soluble organic;

(g) from about 0.5% to about 50% of other compatible selected salt or salt hydrate;

(h) from about 0.25% to about 20% of a polymeric skin feel aid;

and mixtures thereof.

19. The freezer bar of claim 18 wherein said bar contains from about 1% to about 25% of said other compatible salt or salt hydrate (g), wherein said (g) is selected from the group consisting of: sodium chloride, sodium sulfate, disodium hydrogen phosphate, sodium pyrophosphate sodium tetraborate, and other compatible sodium and potassium salts of inorganic acids, sodium acetate, sodium citrate, sodium and potassium salts of short chained organic acids other than sodium acetate and sodium citrate and mixtures thereof.

20. The freezer bar of claim 18 wherein said bar contains from about 2% to about 40% water-soluble organic selected from the group consisting of polyols and urea.

21. The freezer bar of claim 20 wherein said water-soluble organic is selected from the group consisting of: propylene glycol; glycerine; ethylene glycol; sucrose; and other compatible polyols; and urea; and mixtures thereof.

22. The freezer bar of claim 18 in which said said bar has a wax content of from about 2% to about 25%; and wherein said wax has a melting point of from about 120° F. to about 185° F. (49°–85° C.).

23. The freezer bar of claim 22 wherein said wax comprises a paraffin wax.

24. The freezer bar of claim 18 wherein said water and said sodium soap have a ratio of from about 0.25:1 to about 4:1.

25. The freezer bar of claim 24 wherein said water to soap ratio is 0.5:1 to 3:1 and water level is from about 20% to about 35%; wherein said fatty alkyl chains are $C_{14}$ to $C_{22}$ and said sodium soap level in said bar is from about 20% to about 50%; and wherein at least about 50% of said soap is of a single chain length; and wherein synthetic surfactant level is from about 4% to about 25% and said viscosity-enhancing agent level is from about 1% to about 35% and said total sodium soap plus viscosity-enhancing agent level is from about 35% to about 65%; and wherein said water-soluble organic level is from about 2% to about 40%.

26. The freezer bar of claim 25 wherein said water to soap ratio is 0.7:1 to 1.5:1; said water level is from about 20% to about 30%; said fatty alkyl chain is $C_{14}$ to $C_{18}$; said soap level is from about 30% to about 40%; and wherein said single chain length is at least 75%; said synthetic surfactant level is from about 8% to about 16%; and said viscosity-enhancing agent level is from about 5% to about 30% and said total sodium soap plus viscosity-enhancing agent level is from about 40% to about 50%; and said water-soluble organic level is from about 5% to about 20%; and wherein at least 95% of said fatty acid soap is saturated.

27. The freezer bar of claim 1 wherein the water in said freezer bar is reduced by dehydration after Step (4) to a final water level of from about 1% to about 10%.

28. A rigid, low smearing, mild personal cleansing freezer bar comprising a skeleton structure having a rigid interlocking, semi-continuous open, three-dimensional crystalline mesh of from about 15% to about 85% sodium soap, and from about 15% to about 40% water;

wherein said soaps have saturated fatty alkyl chains of $C_{12}$–$C_{24}$ carbon atoms and mixtures thereof at a level of from about 75% to about 100% by weight of total fatty acid soap;

and wherein from 0% to about 20% of said total fatty acid soap are selected from the group consisting of: unsaturated fatty acid soaps and salts of fatty acid with chain lengths $C_{10}$ and shorter; and wherein said cleansing freezer bar is made using a scraped wall heat exchanger.

29. The freezer bar of claim 28 wherein said bar comprises: from about 1% to about 70% of a viscosity-enhancing agent; wherein said sodium soap and said viscosity-enhancing agent sum is from about 30% to about 85% by weight of the bar; and wherein said viscosity-enhancing agent is selected from the group consisting of: waxes, jellies, and greases; magnesium and calcium salts of saturated carboxylic fatty acids of chain length $C_{12}$–$C_{24}$; aluminosilicates and clays, and mixtures thereof.

30. The freezer bar of claim 29 wherein said viscosity-enhancing agent level is selected from the group consisting of:

up to about 40% of wax, jelly and grease;

up to about 35% of said magnesium or calcium soap;

up to about 25% of said aluminosilicate and clay;

and mixtures thereof.

31. The freezer bar of claim 30 wherein said bar comprises:

from about 1% to about 70% of another bar ingredient selected from the group consisting of:

up to about 15% said potassium soap;

up to about 15% triethanolamine soap;

up to about 40% of a compatible salt of dicarboxylic acid;

up to about 60% of synthetic surfactant;

up to about 50% of a water-soluble organic;

up to about 50% of other compatible selected salt and/or salt hydrate;

up to about 20% of a polymeric skin feel aid;

and mixtures thereof.

32. A personal cleansing soap freezer bar composition comprising a rigid, interlocking mesh of sodium soap fibers; said soap bar comprising: from about 15% to about 40% water; and from about 15% to about 85% sodium fatty acid soap composed of at least about 75% saturated fatty alkyl chains having 12–24 carbon atoms of which at least about 25% of said saturated fatty alkyl chains is of a single chain length; and from about 2% to about 60% by weight of a hygroscopic synthetic surfactant wherein said hygroscopic synthetic surfactant is selected from surfactants which absorb at least about 20% of their dry weight in water at 26° C. and 80% Relative Humidity in three days; and wherein said freezer bar is made using a scraped wall heat exchanger.

33. The personal cleansing freezer bar of claim 32 wherein said hygroscopic synthetic surfactant is selected from the group consisting of alpha sulfo esters; alkyl sulfates; alkyl ether carboxylates; alkyl betaines; alkyl sultaines; alkyl amine oxides; alkyl ether sulfates; and mixtures thereof.

34. A process for making a personal cleansing freezer bar comprising a skeleton structure having a rigid interlocking, semi-continuous open, three-dimensional crystalline mesh of sodium soap; wherein said process comprises the following steps:

(1) mixing a molten mixture comprising by weight of said bar: from about 15% to about 85% of said soap and from about 15% to about 40% water;

(2) cooling said mixture to a semi-solid in a scraped wall heat exchanger freezer;

(3) extruding said semi-solid as a soft plug; and (4) further cooling said soft plug to provide said personal cleansing bar; and wherein the soap of Step (1) is made by mixing parent fatty acid, sodium hydroxide base, and said water at from about 170° F. to about 200° F. (76°–93° C.); wherein the fatty acid is selected from the group consisting of fatty alkyl chains of $C_{12}$–$C_{24}$ carbon atoms at a level of from about 75% to about 100% by weight of the total fatty acid and unsaturated fatty acids, and fatty acids of chain length $C_{10}$ and shorter at a level of from 0% to about 20% of the total fatty acid; and wherein when the mixture of Step (1) is cooled in a scraped wall heat exchanger from about 180° F. to about 200° F. (82°–93° C.), to a final freezer outlet temperature of from about 135° F. to about 180° F. (57°–82° C.); and wherein said cooled mix of Step (2) is extruded onto a moving belt as a soft plug which is then cooled to fully crystallize and to provide said freezer bar.

35. The process of claim 34 wherein the mixture in Step (1) is flash dried at a temperature of from about 225° F. to about 315° F. (135°–157° C.) and a pressure of from about 30 psi to about 100 psi (from about 1550 to about 5170 mm Hg) to obtain a final bar moisture (water) level of from about 15% to about 40%; and wherein the temperature entering the freezer is from about 200° F. to about 220° F. (93°–104° C.).

36. The process of claim 34 wherein the mixture is aerated before cooling in the scraped wall heat exchanger.

37. The process of claim 34 wherein the freezer outlet temperature is from about 145° F. to about 180° F. (63°–82° C.).

38. The process of claim 34 wherein the freezer outlet temperature is from about 155° F. to about 175° F. (68°–79° C.).

39. The process of claim 34 wherein other bar ingredients and viscosity-enhancing agents are added to Step (1) at a temperature of from about 180° F. to about 200° F. (82°–93° C.); said other ingredients are selected from the group consisting of:

from about 1% to about 15% said potassium soap;

from about 1% to about 15% triethanolamine soap;

from about 1% to about 40% of a compatible salt of dicarboxylic acid;

from about 1% to about 60% of synthetic surfactant;

from about 1% to about 60% of other impalpable water-insolubles;

from about 1% to about 50% of a water-soluble organic;

from about 0.5% to about 50% of other compatible selected salt or salt hydrate;

from about 0.25% to about 20% of a polymeric skin feel aid;

and mixtures thereof;

and wherein said viscosity-enhancing agent is selected from the group consisting of:

(A) from about 1% to about 40% wax, jelly or grease, and mixtures thereof;

(B) from about 1% to about 35% of said magnesium or calcium of saturated $C_{12}$–$C_{24}$ fatty acid soap, and mixtures thereof;

(C) from about 0.5% to about 25% of said aluminosilicate or clay;

and mixtures of said (A), (B) and (C).

40. The process of claim 39 wherein said bar has a final water level of from about 20% to about 35% by bar weight.

* * * * *